US005313812A

United States Patent [19]

Eklund et al.

[11] Patent Number: 5,313,812

[45] Date of Patent: May 24, 1994

[54] DOOR LOCK SECURITY SYSTEM

[76] Inventors: Sigurd T. Eklund, 61 Slalom Drive, Moonstone, Ontario, Canada, L0K 1N0; Rainer A. Eklund, 7272 Bendigo Circle, Mississauga, Ontario, Canada, L5N 1Z5

[21] Appl. No.: 944,110

[22] Filed: Sep. 11, 1992

[51] Int. Cl.[5] ..... E05B 13/02

[52] U.S. Cl. ..... 70/416; 70/452

[58] Field of Search ..... 70/416, 429, 455, 452

[56] References Cited

U.S. PATENT DOCUMENTS

| | | | |
|---|---|---|---|
| 155,642 | 10/1874 | Eldridge | 70/429 |
| 756,064 | 3/1904 | Sherman . | |
| 897,473 | 9/1908 | Medler . | |
| 899,801 | 9/1908 | Pellow | 70/429 |
| 921,390 | 5/1909 | Finn | 70/429 |
| 1,455,627 | 5/1923 | Lawson | 70/429 |
| 1,700,135 | 1/1929 | Lanes | 70/416 |
| 2,441,067 | 5/1948 | Helmes | 70/429 |
| 2,463,195 | 3/1949 | Mungan | 70/416 |
| 2,528,757 | 11/1950 | Kindler | 70/429 |
| 2,602,319 | 7/1952 | Jacobi | 70/455 |
| 3,263,462 | 8/1966 | Suroff et al. | 70/447 |
| 3,423,974 | 1/1969 | Bernsley | 70/416 |
| 3,748,882 | 7/1973 | Dusault, Jr. et al. | 70/416 |
| 3,921,423 | 11/1975 | Hollins | 70/416 |
| 3,933,014 | 1/1976 | Moses | 70/416 |
| 4,185,483 | 1/1980 | Lupton et al. | 70/416 |
| 4,279,137 | 7/1981 | Cook | 70/416 |
| 4,673,202 | 6/1987 | Willis | 292/162 |
| 4,827,745 | 5/1989 | Baugh | 70/416 |
| 4,869,086 | 9/1989 | Richards | 70/416 |
| 4,947,663 | 8/1990 | Yeager | 70/416 |
| 5,000,498 | 3/1991 | Upchurch | 292/288 |
| 5,007,263 | 4/1991 | Taylor | 70/416 |

FOREIGN PATENT DOCUMENTS

| | | | |
|---|---|---|---|
| 2544789 | 4/1977 | Fed. Rep. of Germany | 70/429 |
| 611337 | 7/1926 | France | 70/429 |

*Primary Examiner*—Peter M. Cuomo
*Assistant Examiner*—Darnell M. Boucher
*Attorney, Agent, or Firm*—Rothwell, Figg, Ernst & Kurz

[57] ABSTRACT

A door security system is used in conjunction with a lock such as a deadbolt lock having an "inside" located actuating handle, of the type used in hotel rooms, having a major and a minor dimensional axis. The security device has a baseplate that fits beneath the faceplate of the lock and which can be oriented during installation in relation to the shaped actuating handle of the lock. The baseplate of the security device extends eccentrically off center and supports a pivot post that carries a latch locking plate. The locking plate is pivotally supported on the pivot post, for pivotal rotation thereabout, and has an arcuate passage off-set from the pivot post, in use to receive the lock actuating handle. In use, with the baseplate installed beneath the faceplate of the lock and the lock handle rotated to extend the bolt, the locking plate may be rotated about the pivot post, swinging the arcuate passage over the lock handle in immobilizing relation therewith. In this condition the shaped lock handle cannot be rotated, and the lock is restrained in a locked condition despite the use of a proper key, externally.

8 Claims, 2 Drawing Sheets

DOOR LOCK SECURITY SYSTEM

TECHNICAL FIELD

This invention is directed to a security device, and in particular to a lock restraining device for immobilizing a lock against keyed access.

BACKGROUND ART

The problem of maintaining personal security against unauthorized entry is a longstanding problem.

In instances such as hotel rooms or in the case of condominium dwellings occasions arise when the privacy and security of an occupant is compromised by the entry of a third party, using a duplicate key.

Many solutions have been advanced, or are in wide spread use, such as safety chains, in the case of hotels and apartments. These have aesthetic disadvantages, as well as requiring the user to perform a sometimes difficult operation, in applying the chain. Also, in the case of fire or other emergency, the safety chain may present a serious obsticle to the occupant in exiting the room.

Many previous efforts have been made with a view to immobilizing the lock handle, such as:

U.S. Pat. No. 1,455,627, Lawson—May 1923;
U.S. Pat. No. 1,700,135, Lanes—Jan. 1929;
U.S. Pat. No. 3,423,974, Bernsley—Jan. 1969;
U.S. Pat. No. 3,263,462, Suroff et al.—1966;
U.S. Pat. No. 3,748,882, Dusault et al.—Jul. 1973;
U.S. Pat. No. 3,921,423, Hollins—Nov. 1975;
U.S. Pat. No. 3,933,014, Moses—Jan. 1976;
U.S. Pat. No. 4,185,483, Lupton et al.—Jan. 1980;
U.S. Pat. No. 4,279,137, Cook—Jul. 1981;
U.S. Pat. No. 4,673,202, Willis—Jun. 1987;
U.S. Pat. No. 4,827,745, Baugh—May 1989;
U.S. Pat. No. 4,869,086, Richards—Sep. 1989;
U.S. Pat. No. 4,947,663, Yeager—Aug. 1990;
U.S. Pat. No. 5,000,498, Upchurch—Mar. 1991; and
U.S. Pat. No. 5,007,263, Taylor—Apr. 1991.

Prior arrangements are generally characterized by their complexity; their need, usually, for separate mounting and attachment; and their expense. Also, in most cases the prior arrangements depend for their successful operation upon the particular orientation of the main axis of the door lock handle, when in the locked condition, in order to ensure engagement of the locking device, to immobilize the lock handle.

DISCLOSURE OF THE INVENTION

The present invention provides a low cost, simple security system having a security device for mounting under the faceplate of an installed lock.

The subject security device has a baseplate insertable beneath the lock faceplate for retention thereby.

The baseplate has an off-center extension which supports a pivot post to which a latch locking plate is secured, for pivotal displacement of the latch locking plate about the pivot post. The latch locking plate has an arcuate locking passage centered upon and radially displaced from the pivot post, in use to receive the lock handle in entered relation therein, when the lock handle is oriented into the locked position, having the major dimensional axis thereof substantially aligned with the locking passage.

The mounting of the baseplate beneath the lock faceplate permits selective angular orientation and some radial adjustment of the pivot post relative to the lock handle, whereby the arc of displacement of the latch locking plate may be pre-set, to ensure satisfactory envelopment of at least a portion of the lock handle by the locking passage of the latch locking plate, when pivotted thereover to effectively immobilize the lock handle.

Thus, the satisfactory installation of the security device is assured, regardless of the direction of orientation of the lock handle, when in the locked position.

Owing to the adoption of an arcuate locking passage centered upon the pivotal axis of the latch locking plate, with the latch handle located within the locking passage any point of contact between the latch handle and the walls of the locking passage, can transmit forces solely in a radial direction, towards or away from the pivotal axis of the latch locking plate. Thus, the application of turning force to the lock handle, as by a key inserted into the door lock in an attempt to open the lock, cannot generate any effective rotational movement upon the latch locking plate, to release the lock handle.

The presently disclosed security device may incorporate a positional detent, to retain the latch locking plate in a desired position when disengaged.

Alternatively or additionally, the latch locking plate may frictionally engage the base plate, in order to stabilize its position when disengaged.

It is contemplated that an abbreviated latch locking plate may be provided to enclose an end portion of the lock handle, including stop means to locate the lock handle in effectively entered relation in the locking plate The present invention thus provides, in a lock handle immobilizing device for use with a lock having a rotatable handle of shaped, non-circular planform with a major dimensional axis and a minor dimensional axis, a locking plate having a locking passage in use to receive at least a portion of the handle therein in entered, immobilized relation; and locking plate pivot means located in spaced apart, substantially parallel relation with the axis of rotation of the rotatable handle, whereby in use the locking plate may be selectively pivotted clear of the handle, and swung about the pivot means to at least partially contain the lock handle in entered, non-rotatable relation therein when in a locked position.

BRIEF DESCRIPTION OF THE DRAWINGS

Certain embodiments of the present invention are described by way of illustration without limitation of the invention thereto, reference being made to the accompanying drawings, wherein.

BEST MODE OF CARRYING OUT THE INVENTION

Figure 1:
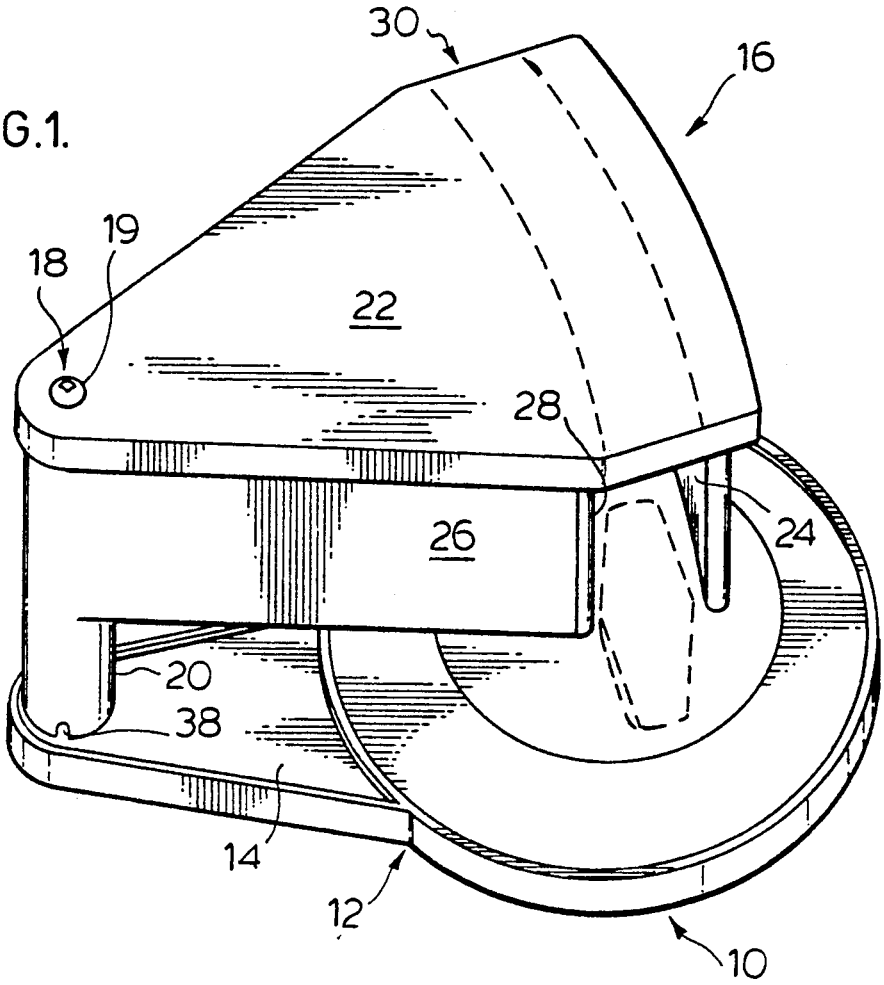
FIG. 1 is a perspective view of the security device in accordance with the present invention.
Figure 2:
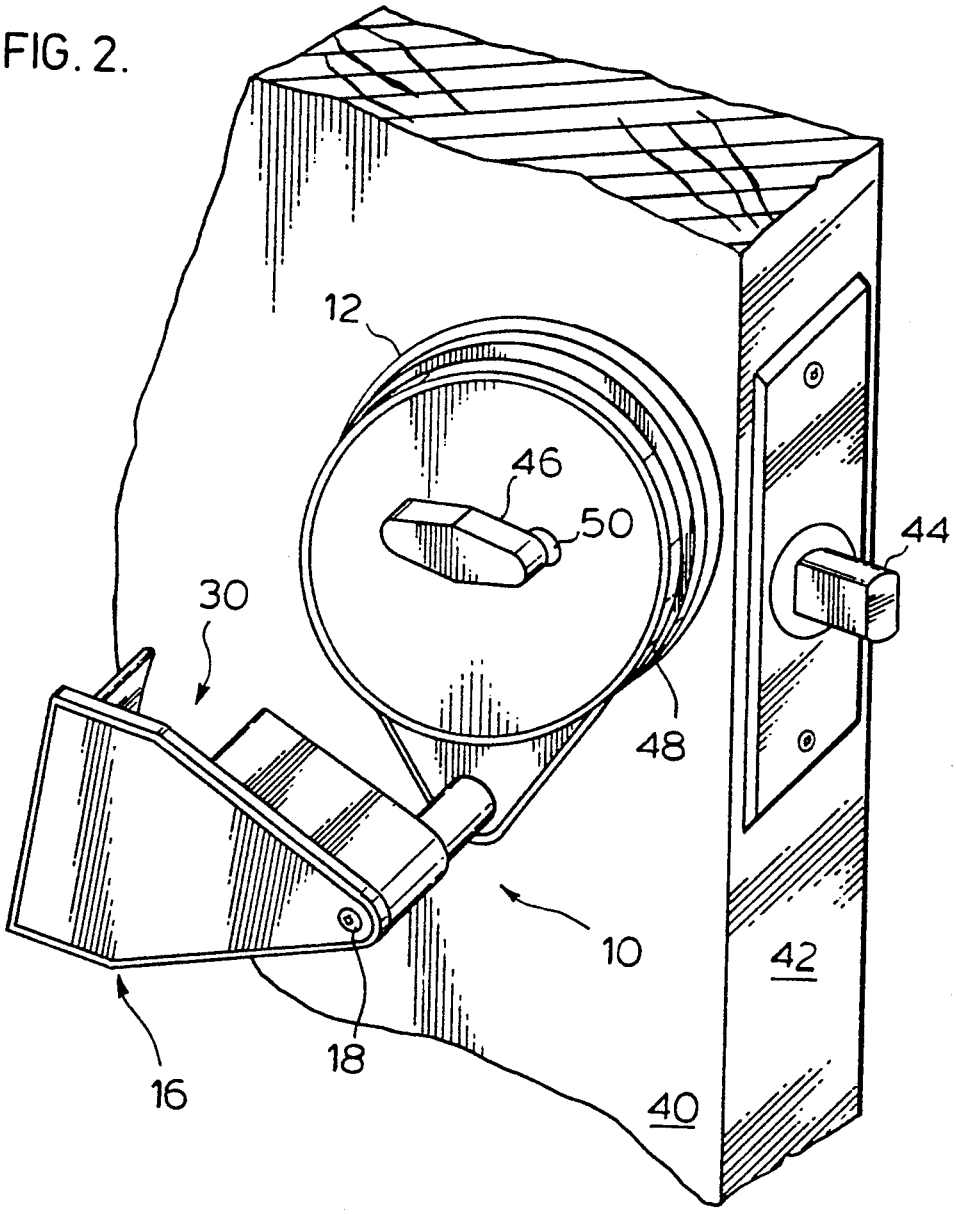
FIG. 2 is a perspective view showing a portion of a door and lock, with the subject security device installed thereon.

Referring to FIGS. 1 and 2, the security device 10 has a thin baseplate 12 of substantially annular form with an off center extended portion 14 of generally triangular shape.

A latch locking plate 16 is pivotally secured at 18 by way of screw 19 to the baseplate portion 14.

The locking plate 16 comprises a pivot portion 20, a cover portion 22 generally comprising a part triangular segment, having an arcuate, radially outer skirt wall portion 24 and a radially inner hollow segment 26. The segment 26 has a radially outer wall 28 substantially parallel with skirt wall portion 24, spaced radially inwardly therefrom, relative to pivotal axis 18 and defining an arcuate passage 30 therebetween, shown in phantom.

Figure 3:
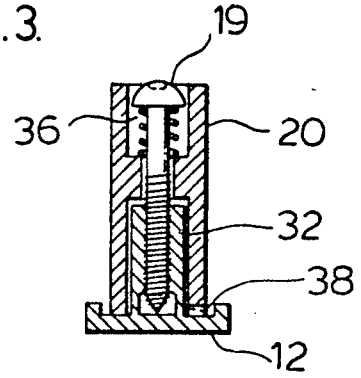
FIG. 3 is a diametric section, in elevation, through the pivot axis of FIG. 1.

Referring to FIG. 3, the pivot portion 20 of locking plate 16 comprises a cylindrical housing seated upon an upstanding post portion 32 of baseplate 12. A screw 19 threaded into post portion 32, and compression spring 36 serve to secure the pivot portion 20 in downwardly compressed relation bearing against the baseplate 12.

The baseplate 12 has one or more raised detent ribs 38 upstanding therefrom. The bottom surface of pivot portion 20 has one or more grooves corresponding to raised detent ribs 38, for movably stabilizing locking plate 16.

Referring to FIG. 2, a door 40 has a key-operated deadbolt type of lock 42 installed therein, being illustrated with the bolt 44 thereof extended in the locked condition. The key hole is on the reverse face of door 42, and is not seen here.

In the instance of the lock 42 illustrated the lock handle 46 is horizontally oriented when locked; that is to say, the main axis of lock handle 46 extends substantially laterally, when in the locked condition.

The raised faceplate 48 of lock 42 is secured by two screws 50, of which a portion of one can be seen, partially concealed by lock handle 46.

With the lock 42 disengaged the screws 50 may be readily removed, permitting the faceplate 48 and lock handle 46 to be moved, and the baseplate 12 of security device 10 positioned therebeneath. Replacement of faceplate 48 along with lock handle 46 and securement thereof with screws 50, or somewhat longer ones if so required, secures the assembly. With the screws 50 but lightly tightened, and with lock 42 in a locked condition the location of pivot axis 18 can be readily adjusted so that the locking plate 16 can be pivotted about its rotational axis 18 so that the passage 30 traverses and encloses lock handle 46. The screws 50 are then firmly tightened, and installation of security device 10 is complete.

In the disengaged position the locking plate 16 is stabilized by friction and/or the detent rib 38 to remain clear of the lock handle 46.

With the lock 42 engaged and the handle 46 positioned in the "closed" position, the locking plate 16 is readily pivotted in arcuate displacement to encompass and contain the lock handle 46. The width of passage 30 precludes any effective rotation of the handle 46, so that the lock is totally immobilized. Also, as stated above, the form of passage 30 totally precludes any opening displacement of the locking plate 16 by attempted rotation of lock handle 46, by way of a key.

In the event that an occupant within the room wishes to disengage the security device 10, even in an instance where external turning pressure is being exerted by a key upon the lock handle 46, the arcuate walls of the passage 30, centered upon pivot axis 18, permit ready rotation of the locking plate 16 to the disengaged position, against frictional forces that may be generated by turning rudments acting on the lock handle 46.

The two main components, the baseplate 12 and the locking plate 16 may be die cast in engineering plastic, to assure adequate strength and low friction or deformation, against attempted forced access.

In use, the locking plate 16 provides a safety cover to the passage 30, such that the fingers of a user need not be compromised or jammed by a third party opening the lock 42 at the time of applying the locking plate 10.

INDUSTRIAL APPLICABILITY

This device has an extremely wide potential application, both in hotels and in private use.

What is claimed:

1. In combination, a door lock having a removable, inside faceplate, an interior rotatable lock spindle extending through the faceplate, and a lock handle extending from the spindle, being shaped, non-circular section having a major lateral dimension and a minor lateral dimension, said handle being rotated on actuation of the lock, from a first unlocked position to a second, locked position;

a lock handle immobilizing device for installation with said lock, said immobilizing device having a baseplate, the baseplate having a substantially planar first portion for installation in secured relation beneath said lock faceplate, said base plate having an aperture therein for passage of said spindle therethrough, a second portion of said baseplate extending outside said lock faceplate, said baseplate being selectively rotatably positionable beneath said lock faceplate to orient said second portion in predetermined angular relation from said lock handle;

said baseplate second portion having pivot means thereon; and a locking plate pivotally mounted thereto for pivotable displacement of said locking plate substantially parallel with said faceplate, said locking plate having a locking passage therein, for arcuate displacement of said locking passage over at least a portion of said lock handle in containing, immobilizing relation therewith, whereby, in use, with said baseplate selectively pre-positioned relative to said lock handle when in said locked position and non-rotatably secured by said faceplate, and with said handle in said second, locked position, said locking plate may be pivotally rotated about said pivot means to displace said locking passage in aligned relation over at least a portion of said lock handle, to immobilize said handle against rotation thereof.

2. The combination as set forth in claim 1, said locking passage having curved side wall portions, and an arc of curvature being substantially centered on said pivot means, to effectively limit variable forces acting upon said locking plate, due to attempted rotation of said lock handle, to an axis passing substantially through said pivot means.

3. The combination as set forth in claim 1, said pivot means having the pivot axis thereof substantially parallel with the axis of rotation of said lock handle, and located in spaced relation therefrom.

4. The combination as set forth in claim 1, said immobilizing device said locking passage comprising an arcuate passage substantially centered about said pivot means.

5. The combination as set forth in claim 2, said immobilizing device including positioning means for selectively pivotably positioning said locking plate in an engaged or a disengaged position.

6. The combination as set forth in claim 1, said first portion comprises an annular plate portion for location, in use, beneath said faceplate portion of said lock, in secured relation thereby.

7. The combination as set forth in claim 1, said immobilizing device including spring means resiliently loading said locking plate on said pivot means.

8. The combination as set forth in claim 7, said immobilizing device including detent means connecting said locking plate with said baseplate, in use to movably restrain said locking plate in an inoperative position, with said locking plate spaced from said lock handle, in disengaged relation therewith.

* * * * *

UNITED STATES PATENT AND TRADEMARK OFFICE

CERTIFICATE OF CORRECTION

PATENT NO. : 5,313,812

DATED : May 24, 1994

INVENTOR(S) : Sigurd T. Eklund et al.

It is certified that error appears in the above-indentified patent and that said Letters Patent is hereby corrected as shown below:

Col. 2, line 29, "plate" should be --plate.--.

Col. 4, delete the text of claim 1 (lines 10-47) in its entirety and insert therefor:

--In combination, a door lock having a removable, inside faceplate, and a lock handle protruding clear of said faceplate, said handle being of shaped, non-circular section having a major lateral dimension and a minor lateral dimension, said handle being rotated on actuation of the lock, from a first unlocked position to a second, locked position; and a lock handle immobilizing device for installation with said lock, said immobilizing device having a baseplate, the baseplate having a substantially planar first portion for installation in secured relation beneath said faceplate, said baseplate having an aperture therein, to permit operation of said lock handle, a second portion of said baseplate extending outside said lock faceplate, said baseplate being selectively rotatably positionable beneath said lock faceplate to orient said second portion in predetermined angular relation from said lock handle; said baseplate second portion having pivot means thereon; a locking plate pivotally mounted thereto for pivotal displacement of said locking plate substantially parallel with said faceplate, said immobilizing device including detent means connecting said locking plate with said baseplate, in use to movably restrain said locking plate in an inoperative position

UNITED STATES PATENT AND TRADEMARK OFFICE

CERTIFICATE OF CORRECTION

PATENT NO. : 5,313,812

DATED : May 24, 1994

INVENTOR(S) : Sigurd T. Eklund et al.

It is certified that error appears in the above-indentified patent and that said Letters Patent is hereby corrected as shown below:

when disengaged from said lock handle, said locking plate having a locking passage therein, for arcuate displacement of said locking passage over at least a portion of said lock handle in containing, immobilizing relation therewith, and a cover portion over said locking passage to preclude contact with said lock handle during operation of said immobilizing device; whereby, in use, with said baseplate selectively pre-positioned relative to said lock handle when in said locked position and non-rotatably secured by said faceplate, and with said handle in said second, locked position, said locking plate may be pivotally rotated about said pivot means to displace said locking passage in aligned relation over at least a portion of said lock handle, to immobilize said handle against rotation thereof, and said locking plate may be pivoted away from said handle and restrained in an inoperative position by said detent means.--

UNITED STATES PATENT AND TRADEMARK OFFICE

CERTIFICATE OF CORRECTION

PATENT NO. : 5,313,812

DATED : May 24, 1994

INVENTOR(S) : Sigurd T. Eklund et al

It is certified that error appears in the above-indentified patent and that said Letters Patent is hereby corrected as shown below:

Column 4, lines 59-60, delete "said immobilizing device"; and line 67, insert --wherein -- before "said".

Column 5, line 6 through Column 6, line 5, delete claim 8 in its entirety.

Signed and Sealed this

Eighth Day of November, 1994

Bruce Lehman

*Attest:*

BRUCE LEHMAN

*Attesting Officer*

*Commissioner of Patents and Trademarks*